United States Patent [19]

Glenn

[11] 4,094,615

[45] June 13, 1978

[54] BLADE ATTACHMENT STRUCTURE FOR GAS TURBINE ROTOR

[75] Inventor: Robert G. Glenn, Huntington Valley, Pa.

[73] Assignee: Electric Power Research Institute, Inc., Palo Alto, Calif.

[21] Appl. No.: 754,725

[22] Filed: Dec. 27, 1976

[51] Int. Cl.[2] ..... F01D 5/30

[52] U.S. Cl. ..... 416/215; 416/220 R; 416/248; 416/193 A; 416/241 B

[58] Field of Search ..... 416/219, 220, 248, 215, 416/193 A, 212 A, 95, 241 B, 212

[56] References Cited

U.S. PATENT DOCUMENTS

| | | | |
|---|---|---|---|
| 1,362,074 | 12/1920 | Baumann | 416/248 |
| 2,873,947 | 2/1959 | Perry | 416/241 |
| 2,916,257 | 12/1959 | Poellmitz et al. | 416/220 |
| 3,137,478 | 6/1964 | Farrell | 416/244 A |
| 3,501,249 | 3/1970 | Scalzo et al. | 416/95 |

FOREIGN PATENT DOCUMENTS

| | | | |
|---|---|---|---|
| 826,332 | 12/1951 | Germany | 416/220 |
| 238,024 | 9/1945 | Switzerland | 416/248 |
| 189,131 | 3/1923 | United Kingdom | 416/219 |
| 740,757 | 11/1955 | United Kingdom | 416/219 |
| 1,295,003 | 11/1972 | United Kingdom | 416/95 |

*Primary Examiner*—Everette A. Powell, Jr.
*Attorney, Agent, or Firm*—Townsend and Townsend

[57] ABSTRACT

Improved attachment structure for connecting ceramic blades to the rotor disk of a gas turbine rotor. The structure includes a plurality of metallic attachment pieces having roots inserted into respective grooves in the outer periphery of the rotor disk. Each attachment piece has an outer peripheral groove for receiving the root of a corresponding turbine blade formed of ceramic material. Specific embodiments of an attachment piece and a blade are disclosed, the blade having a base which engages the outer peripheral face of the corresponding attachment piece. The blade base and the corresponding attachment piece have aligned, spaced grooves at the opposed ends thereof for receiving ceramic plates which cover the adjacent parts of the attachment piece. Certain ends of the ceramic plates define recesses for receiving metallic plates which extend radially of the rotor disk and transmit torque from the blade to the attachment piece and thereby to the rotor disk.

10 Claims, 3 Drawing Figures

BLADE ATTACHMENT STRUCTURE FOR GAS TURBINE ROTOR

This invention was made under contract with or supported by the Electric Power Research Institute, Inc.

This invention relates to improvements in the rotor of a gas turbine engine and, more particularly, to an improved means for coupling a plurality of ceramic turbine blades to the rotor disk of a gas turbine engine.

BACKGROUND OF THE INVENTION

The efficiency of a gas turbine engine may be improved by raising the gas inlet temperature thereto. Under the present state of the art, gas inlet temperatures are limited by the thermal characteristics of known metals which conventionally are used to form the blades and rotor disk of a gas turbine engine. If cooling of the rotor parts is provided beyond a certain level, the penalties override the gains. As a result, the technology is currently moving in the direction of the use of turbine blades of ceramic materials to replace use of metal in the construction of the turbine blades.

A major problem associated with the use of ceramic turbine blades is the attaching of the blades to a metal rotor disk. The disk itself must be fully protected from exposure to the high temperatures of the incoming gases to the turbine. Moreover, the ceramic blades themselves must be of simple shapes to avoid stress risers therein.

In view of the foregoing problems, a need has arisen for new and improved means for attaching ceramic turbine blades to a rotor disk.

SUMMARY OF THE INVENTION

The present invention satisfies the foregoing need by providing structure which includes a plurality of ceramic turbine blades and metallic attachment pieces for connecting the blades to the outer periphery of a turbine rotor disk. To this end, each blade has a root for insertion into an outer peripheral groove or recess in a corresponding attachment piece, and each attachment piece has a groove which is inserted in a groove in the outer periphery of the rotor disk. By virtue of the aforesaid construction, the outer periphery of the rotor disk is completely covered by the attachment pieces to protect it from direct contact with the high temperature gases.

In a specific embodiment disclosed herein, the base of each blade and the corresponding attachment piece have spaced grooves in the opposed ends thereof for receiving respective ceramic plates which isolate the adjacent parts of the attachment piece from the high temperature gases to which the blades are subjected. This feature thereby protects the rotor disk from such high temperature gases. An additional feature is the use of metallic plates in recesses at certain sides of the attachment pieces. The purpose of the metallic plates is to transfer the torque from the blades to the corresponding attachment pieces and thereby to the rotor disk.

The blade roots extend axially or transversely of the axis of the rotor disk. If they extend transversely, they are effectively embedded in their attachment pieces. Thus, gases cannot bypass through the blade roots as in axially oriented roots. Furthermore, a greater cross section through the blade may be achieved with this construction. It also avoids the problems associated with an all metal turbine rotor assembly in which metallic blade roots are connected directly into the grooves of a metallic rotor disk.

The primary object of this invention is to provide an improved turbine rotor wherein ceramic turbine blades are coupled by way of intermediate attachment pieces to a rotor disk of the turbine yet the rotor disk is protected from the high temperature gases associated with the turbine blade to thereby prevent damage to the rotor disk by mechanical and thermal stresses while providing a relatively high efficiency for the turbine engine.

Another object of this invention is to provide an improved turbine rotor of the type described wherein each attachment piece is protected by ceramic plates at opposed ends thereof to thereby prevent transfer of heat energy from the gases to the rotor disk through the attachment piece yet torque from the blades to the rotor disk is effectively transferred.

Other objects of this invention will become apparent as the following specification progresses, reference being had to the accompanying drawings for an illustration of various elements of the turbine rotor of this invention.

IN THE DRAWINGS

Figure 1:
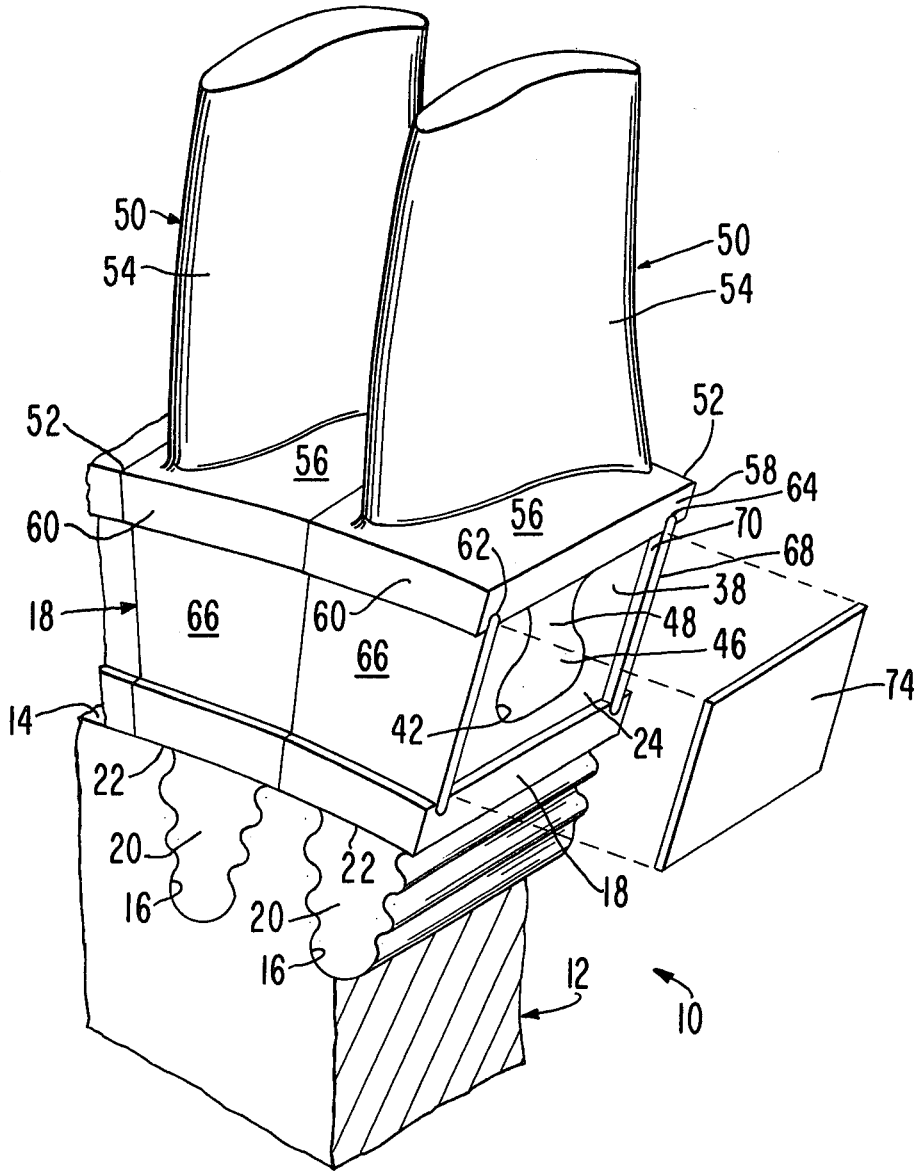
FIG. 1 is a fragmentary, perspective view of the turbine rotor of this invention, showing a pair of blades mounted on the outer periphery of the rotor.
Figure 2:
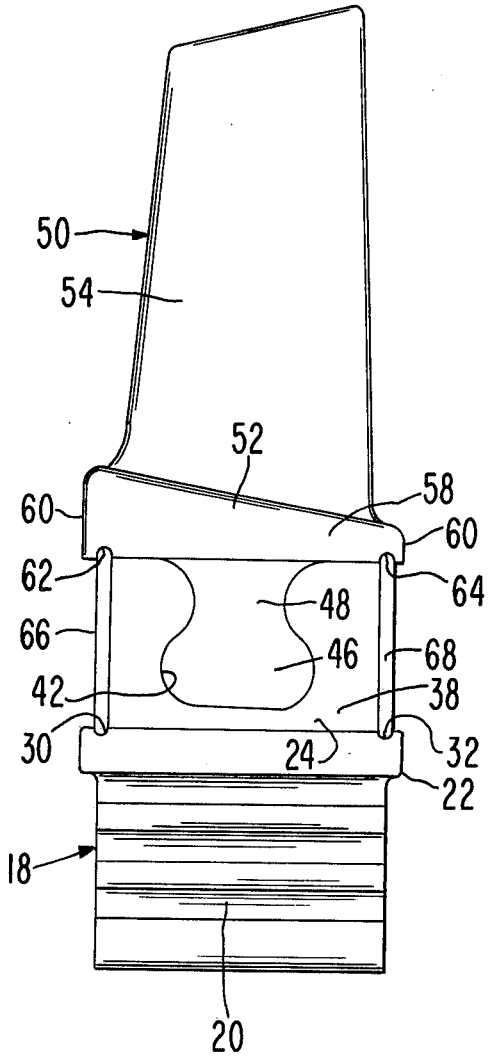
FIG. 2 is a side elevational view of one of the blades and its attachment piece.

The improved turbine rotor of the present invention is broadly denoted by the numeral 10 and is illustrated in FIG. 2. It includes a rotor disk 12, only a portion of which is shown in FIG. 1. Rotor disk 10 is rotatable about a central axis and has an outer periphery 14 provided with a plurality of spaced grooves 16 therein, there being an intermediate blade attachment piece 18 for each groove 16, respectively.

Each attachment piece 18 is of the type illustrated in FIG. 2. It includes a fir tree type root 20 adapted to be inserted into the corresponding groove 16 end-wise of the latter. Attachment piece 18 further includes a base 22 on the outer periphery of root 20, and a grooved dovetail part 24 extending radially outwardly from base 22. Root 22, base 22, and part 24 are integral with each other and are formed from a high temperature metal.

Base 22 has a pair of spaced ends 26 and 28 which project slightly outwardly from the corresponding faces of root 20 as shown in FIG. 2. Ends 26 and 28 have open top grooves 30 and 32 which extend transversely of the longitudinal axis of rotor disk 12. Grooves 30 and 32 are at the radially innermost margins of the flat end faces 34 and 36 of part 24.

Figure 3:
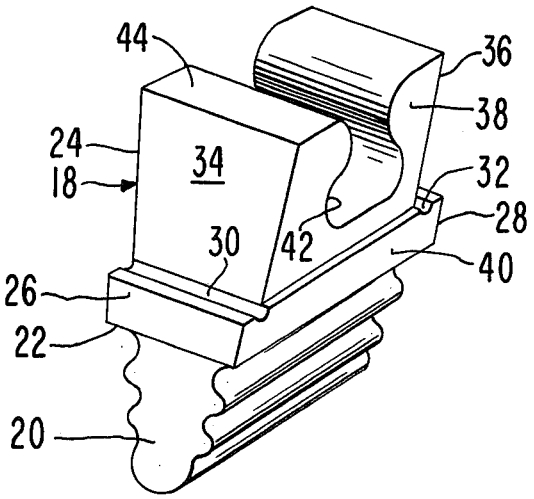
FIG. 3 is a perspective view of an attachment piece for connecting a respective blade to the rotor disk.

Part 24 has a pair of opposed flat sides 38, only one of which is shown in FIGS. 2 and 3. These sides converge toward each other as base 22 is approached. Similarly, the opposed sides 40 of base 22 are slightly convergent toward each other as root 20 is approached. In this way, a plurality of attachment pieces 18 can properly be fitted in place on the outer periphery of rotor disk 12.

Part 24 further includes a groove 42 extending inwardly from the outer periphery 44 thereof, the groove being wider at its innermost portion than it is near its outermost portion. Groove 42 extends longitudinally of grooves 30 and 32 and is adapted to receive the smoothly contoured dovetail type root 46 and neck 48 of a corresponding turbine blade 50 of ceramic material. Root 46 and neck 48 span the distance between sides 38 of part 24 and the outer faces of root 46 and neck 48 at opposed ends thereof are slightly tapered so as to be substantially flush with sides 38.

Blade 50 further includes a base 52 integral with neck 48, and a blade portion 54 integral with base 52. Blade portion 54 can have any suitable configuration, such as a curved chord or straight chord as desired. Blade portion 54 projects outwardly from the outer face 56 of corresponding base 52.

The opposed sides 58 of base 52 are slightly tapered and they converge toward each other as neck 48 is approached. This allows bases 52 of adjacent blades to properly fit in dovetail fashion and abut each other in the manner shown in FIG. 1 when rotor 10 is properly assembled. The opposed ends 60 of base 52 are provided with grooves 62 and 64 at the radially innermost faces thereof as shown in FIGS. 1 and 2. Grooves 62 ad 64 are aligned with grooves 30 and 32 as shown in FIG. 2 and are adapted to slidably receive ceramic plates 66 and 68 which cover flat end faces 34 and 36 of part 24 of attachment piece 18. These plates, therefore, protect the attachment piece and prevent hot gases from directly contacting the same.

The end margins of plates 66 and 68 near each side 38 of each part 24 project outwardly a short distance from side 38 to present a recess 70 for receiving a metal plate 74 which transfers torque from blade 50 to the corresponding attachment piece 18 and thereby to rotor disk 12. Also, bases 22 and 52 project slightly beyond side 38 to further define recess 70.

When properly assembled on the outer periphery of rotor disk 12, attachment pieces 18 are arranged as shown in FIG. 1 with their bases 22 adjacent to each other. Also, the side margins of ceramic plates 66 and 68 are in substantial abutment with side margins of adjacent plates 66 and 68, and sides 58 of bases 52 of blades 50 are also in substantial abutment with each other. In this way, the outer periphery of rotor disk 12 is completely covered so as to be maintained out of contact with the hot gases which impinge upon the blades. Moreover, gas cannot bypass through the blade roots 46 as occurs with axially oriented roots because roots 46 are transverse rather than axial of the axis of rotor disk 12. Also, this permits a greater cross section through the blade root to keep corresponding attachment pieces relatively large and rugged in construction.

The blade roots and corresponding grooves in the attachment pieces can, in another embodiment, extend axially of the central axis of the rotor disk rather than circumferentially as described above. Also, a single attachment piece can accommodate the roots of two blades rather than a single blade as shown in FIG. 1.

I claim:

1. In a turbine rotor: a rotor disk having an outer periphery provided with a number of spaced, axially extending grooves; a plurality of ceramic turbine blades spaced outwardly from said outer periphery; and an attachment piece for each blade, respectively, each attachment piece having a root received within a respective groove of the rotor disk, each attachment piece extending outwardly from said outer periphery for coupling the blades thereto, and having an outer peripheral groove extending transversely to the corresponding groove of the rotor disk, each blade having a root received within the outer peripheral groove of the corresponding attachment piece, each pair of adjacent attachment pieces being in substantial abutment with each other to prevent gases in the vicinity of said blades from contacting the rotor disk.

2. In a turbine rotor as set forth in claim 1, wherein said attachment pieces are of metallic material and the blades and blade roots are of ceramic material.

3. In a turbine rotor: a rotor disk having a central axis and an outer periphery; a plurality of attachment pieces carried by the rotor at the outer periphery thereof, a part of each attachment piece extending outwardly from the outer periphery of the disk, said part of each attachment piece having a pair of opposed sides, the sides of each pair of adjacent attachment pieces being substantially contiguous with each other, each attachment piece having an outer peripheral groove extending circumferentially of the central axis of the rotor disk; a blade for each attachment piece, respectively, the blade having a root received within the groove of its attachment piece; means formed of ceramic material and coupled to portions of each attachment piece and the corresponding blade for covering the ends of said part of the attachment piece; and means coupled with each blade for transmitting torque therefrom to the attachment piece.

4. In a turbine rotor as set forth in claim 3, wherein said covering means includes a pair of ceramic plates for each attachment piece, respectively, the plates being in covering relationship to the ends of said part of the corresponding attachment piece.

5. In a turbine rotor as set forth in claim 4, wherein each attachment piece has a pair of opposed end grooves and each blade has a pair of opposed end grooves aligned with respective end grooves of the corresponding attachment piece, each ceramic plate being flat and being slidably inserted into a corresponding pair of aligned grooves.

6. In a turbine rotor as set forth in claim 5, wherein each of the attachment pieces has a base and each of the corresponding blade has a base, the grooves being in the bases of the attachment piece and the blade, respectively.

7. In a turbine rotor as set forth in claim 3, wherein the sides of each attachment piece are substantially flat and are relatively convergent with each other as the outer periphery of the rotor is approached, said torque transferring means including a plate extending along one of the sides of said part.

8. In a turbine rotor as set forth in claim 7, wherein said covering means includes a pair of ceramic plates in covering relationship to the ends of the part of each attachment piece, respectively, one pair of side margins of the ceramic plates defining a recess, the corresponding torque transfer plate being disposed within the recess.

9. In a turbine rotor as set forth in claim 7, wherein the groove in each attachment piece spans the distance between and is open at said sides, the corresponding blade root spanning the distance between the ends of the groove.

10. In a gas turbine rotor: a rotor disk having a central axis and an outer periphery provided with a plurality of circumferentially spaced grooves therein; a plurality of blade attachment pieces, there being an attachment piece for each groove, respectively, each attachment piece having a root received within a respective groove, a base integral with the root and adjacent to said outer periphery of the rotor disk, and a dovetail part integral with and projecting radially outwardly from the base, said dovetail part having a pair of opposed sides, a pair of opposed ends, and a groove extending between the sides at the radially outermost margin of the dovetail part; a blade for each attachment piece, respectively, each blade having a root received within the groove of the corresponding dovetail part, a base integral with the root and covering the radially outermost margin of the corresponding dovetail part, and a blade portion integral with and extending outwardly from the blade base, the bases of the attachment piece and the blade having respective, aligned, transverse grooves adjacent to the opposed ends of the dovetail part; a ceramic plate for each end of the dovetail part, respectively, each ceramic plate being received within the transverse grooves adjacent to the respective end of the dovetail part, the side margins of the ceramic plates adjacent to one side of the dovetail part cooperating with the bases of the attachment piece and the blade to preserve a recess contiguous to said one side; and a metallic plate in the recess and disposed to transfer torque from the blade to the attachment piece and thereby the rotor disk.

* * * * *